US009995445B2

(12) United States Patent
Chien

(10) Patent No.: US 9,995,445 B2
(45) Date of Patent: Jun. 12, 2018

(54) LIGHTING SYSTEM HAVING IMPROVED UNIDIRECTIONAL INTENSITY

(71) Applicant: Tang-Hao Chien, Tai-Tong (CN)

(72) Inventor: Tang-Hao Chien, Tai-Tong (CN)

( * ) Notice: Subject to any disclaimer, the term of this patent is extended or adjusted under 35 U.S.C. 154(b) by 0 days. days.

(21) Appl. No.: 15/156,699

(22) Filed: May 17, 2016

(65) Prior Publication Data

US 2017/0336037 A1 Nov. 23, 2017

(51) Int. Cl.

| | |
|---|---|
| ***F21V 1/22*** | (2006.01) |
| ***F21S 4/24*** | (2016.01) |
| ***F21V 23/02*** | (2006.01) |
| ***F21V 3/04*** | (2018.01) |
| ***F21V 23/00*** | (2015.01) |
| *F21Y 101/02* | (2006.01) |
| *F21Y 103/00* | (2016.01) |

(52) U.S. Cl.

CPC ..... *F21S 4/24* (2016.01); *F21V 3/0436* (2013.01); *F21V 3/062* (2018.02); *F21V 23/001* (2013.01); *F21V 23/02* (2013.01); *F21Y 2101/02* (2013.01); *F21Y 2103/003* (2013.01)

(58) Field of Classification Search

CPC ..... F21S 4/24; F21V 3/0436; F21V 23/02; F21V 23/001; F21V 3/062; F21Y 2101/02; F21Y 2103/003

USPC ..... 362/217.02

See application file for complete search history.

(56) References Cited

U.S. PATENT DOCUMENTS

| | | | | |
|---|---|---|---|---|
| 6,659,623 | B2 * | 12/2003 | Friend | F21V 21/002 250/504 R |
| 7,273,299 | B2 * | 9/2007 | Parkyn | F21V 5/04 362/244 |
| 7,857,482 | B2 * | 12/2010 | Reo | F21V 5/008 362/225 |
| 8,240,875 | B2 * | 8/2012 | Roberts | F21V 5/002 362/217.05 |
| 8,267,540 | B2 * | 9/2012 | Klu | F21S 8/022 362/153 |
| 8,764,226 | B2 * | 7/2014 | Roberts | F21V 5/002 362/217.02 |
| 9,188,291 | B2 * | 11/2015 | Cassidy | F21S 4/28 |
| 2009/0207602 | A1 * | 8/2009 | Reed | F21S 2/005 362/225 |
| 2010/0177532 | A1 * | 7/2010 | Simon | B29D 11/00278 362/555 |
| 2011/0310598 | A1 * | 12/2011 | Swafford, Jr. | A47F 3/001 362/217.02 |
| 2012/0075857 | A1 * | 3/2012 | Verbrugh | F21S 8/038 362/249.01 |
| 2012/0182755 | A1 * | 7/2012 | Wildner | G09F 9/301 362/555 |

(Continued)

*Primary Examiner* — Claude J Brown

(57) ABSTRACT

A strip of a flexible plastic has a transparent cover surface which permits passage of light and an opposed bottom surface and sides which are opaque to passage of light. A series of spaced apart light emitting diodes are positioned on the top surface in electrical contact with a pair of spaced apart, generally parallel electrical wires running along the length of the top surface and individual electric bulbs are positioned on top of each light emitting diode. When electric current flows through the electrical wires, light is transmitted from each light emitting diode through each bulb and out in a unidirectional manner.

8 Claims, 2 Drawing Sheets

(56) References Cited

U.S. PATENT DOCUMENTS

2012/0188755 A1* 7/2012 Maglica ..... F21S 4/28
362/217.02
2013/0063963 A1* 3/2013 Riesebosch ..... F21V 21/34
362/555
2013/0128555 A1* 5/2013 Brauser ..... A01K 27/006
362/108
2013/0201673 A1* 8/2013 Chien ..... F21V 21/088
362/217.13
2013/0215604 A1* 8/2013 Chu ..... A41D 13/01
362/184
2014/0098535 A1* 4/2014 Smith ..... F21V 5/04
362/238
2014/0247595 A1* 9/2014 Lind ..... G09F 13/0404
362/249.04
2015/0062890 A1* 3/2015 Camarota ..... F21V 5/04
362/223
2015/0117001 A1* 4/2015 Fan ..... F21V 23/001
362/235
2015/0355398 A1* 12/2015 De Vaan ..... G02B 6/0018
362/217.05
2016/0025278 A1* 1/2016 Camarota ..... F21V 5/04
362/219
2016/0033099 A1* 2/2016 Bergman ..... F21S 8/061
362/236
2016/0033105 A1* 2/2016 Odnoblyudov ..... F21V 3/049
362/249.02
2016/0053977 A1* 2/2016 Johannessen ..... F21V 3/049
315/153
2016/0176336 A1* 6/2016 Hoek ..... B60Q 1/323
362/549
2016/0238215 A1* 8/2016 Ohta ..... B64D 11/00
2017/0038036 A1* 2/2017 Guerrieri ..... F21S 4/24
2017/0356631 A1* 12/2017 Satterfield ..... F21V 21/048

* cited by examiner

LIGHTING SYSTEM HAVING IMPROVED UNIDIRECTIONAL INTENSITY

FIELD OF THE INVENTION

This invention relates generally to lighting systems and is particularly related to lighting systems for illuminating various structures such as commercial buildings, stores, homes and other objects. More particularly, this invention relates to a strip of lighting having increased unidirectional intensity capable of emitting greater light intensity in one predetermined direction.

BACKGROUND OF THE INVENTION

The use of lighting strips for illumination of various structures have become increasingly popular in recent years. One example of such lighting strip is disclosed in U.S. Pat. No. 9,115,858 B2 issued on Aug. 25, 2015. This patent describes an extended strip of lights emitting diode (LED) which strip has a protective covering with the light for the LED directed from all directions of the strip (see FIGS. 2, 3 and 4 of the patent). Since the LED light strip is within a transparent protective covering on all sides of the strip, the lights emitted from the LED strip have more limited illumination intensity through each side from a given power source. Frequently, it is desirable to transmit light from a strip of LEDs in one direction only in order to increase the intensity of the illuminated light from a given power source without scattering the light in other directions.

It is therefore an object of the present invention to provide an extended strip of a light source which transmits the light from the light source in one direction.

It is a further object of this invention to provide an extended length of light emitting diode (LED) light strip which has one transparent covering side for permitting the passage of lights therethrough and the other sides being opaque to block the passage of lights through the opaque sides of the strip.

It is also an object of this invention to provide an extended length of an LED light strip having unidirectional light transmitting characteristics in order to focus the transmitted lights in one direction only, thus conserving electric power by preventing transmittal of lights in other directions.

The foregoing and other objects of the present invention will become more apparent from the following detailed description of the invention and accompanying drawings.

SUMMARY OF THE INVENTION

A lighting system is provided for illuminating outer structure with greater intensity by ensuring that the system directs the light in one predetermined direction thus avoiding scattering the light in other directions. The lighting system of this invention is a strip of elongated flexible plastic which has a transparent top surface while the bottom surface and the sides are opaque to prevent passage of light. A series of light emitting diodes are placed in a spaced apart relationship on the top surface in contact with a pair of spaced electric wires, and corresponding plurality of bulbs are positioned on each light emitting diode. When electric current is passed through the wires, each LED is illuminated and light is directed to the bulbs and in turn is emitted to the outside in one predetermined direction. Thus, this system can transmit light in one direction with higher intensity than transmittal of light in several directions.

DETAILED DESCRIPTION OF THE INVENTION

Figure 1:
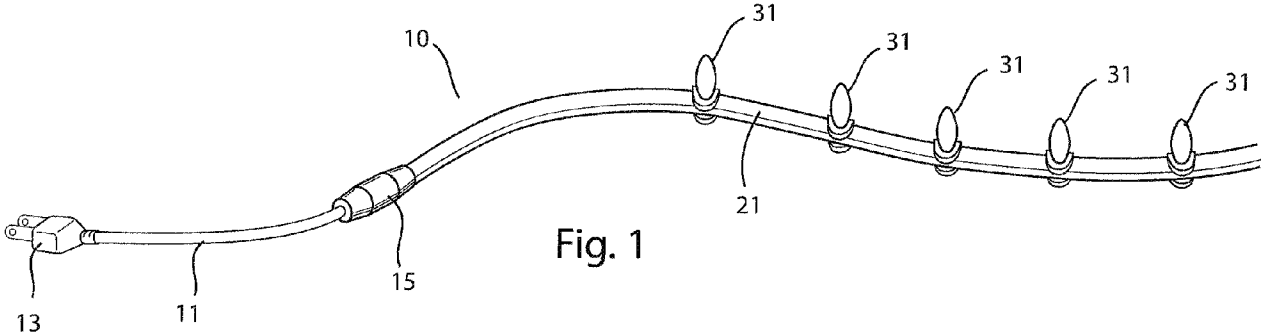
FIG. 1 is a perspective view of a section of an elongated strip with an end plug, a connector, and several spaced apart light bulbs clipped on the elongated strip.
Figure 2:
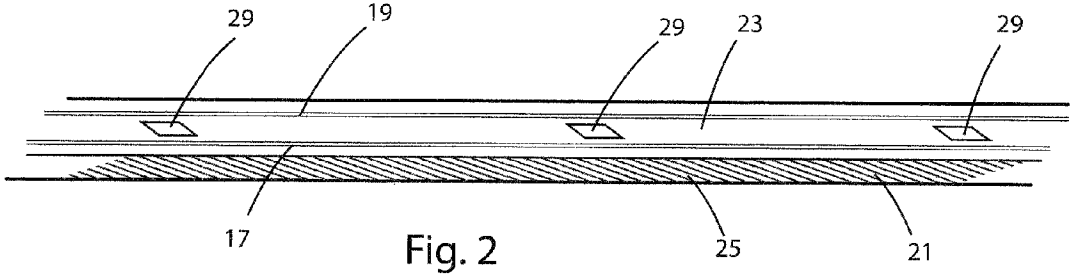
FIG. 2 is an exploded upper perspective view of the elongated strip showing the LEDs spaced apart on the top surface of the strip and illustrating contact of LEDs with the spaced apart parallel electric wires along the surface.
Figure 4:
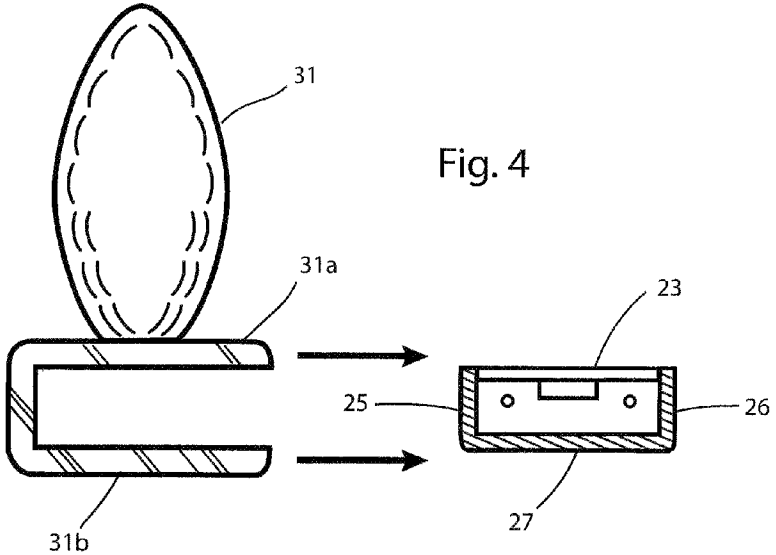
FIG. 4 is a side perspective view of the light bulb shown in FIG. 3 clipped on the opaque side of the elongated strip.
Figure 5:
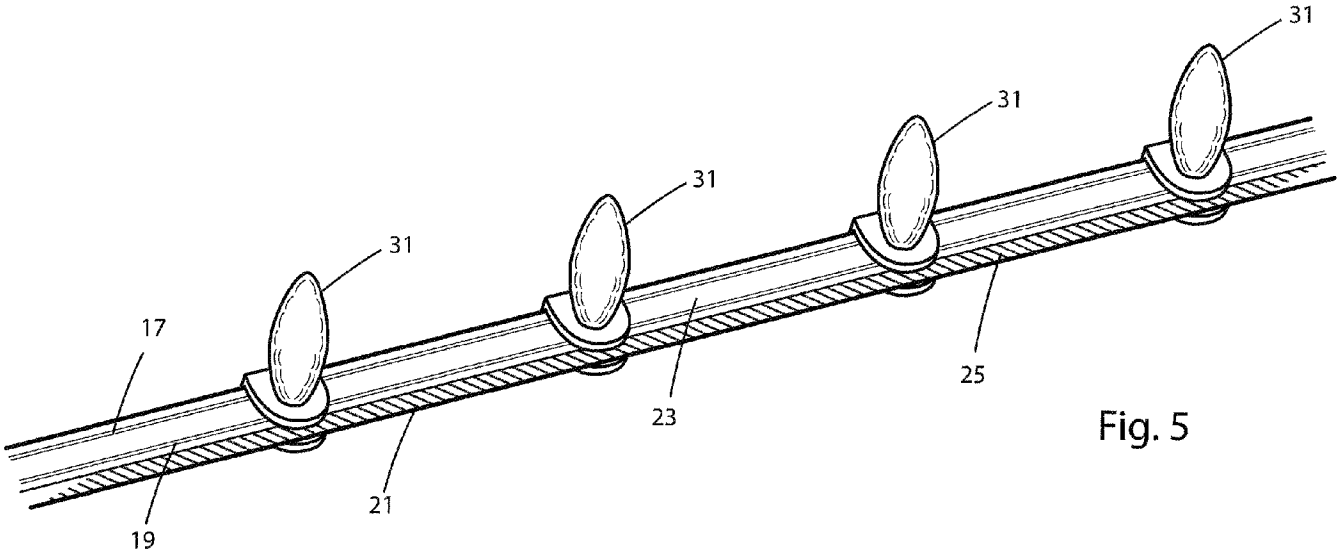
FIG. 5 is an exploded perspective view of several spaced apart light bulbs clipped on the elongated strip over the spaced apart LEDs.

Referring to the drawings wherein like reference numerals designate like parts, FIG. 1 shows an extended light strip system 10 having an insulated cable 11 connected to an electric plug 13 which can be connected at one end to a source of electric power supply (not shown) and is connected at its other end to a connector 15. The electric current flows through the spaced apart parallel wires 17,19 (see FIGS. 2 and 5) which stretch along the top of the extended strip 21 in parallel with each other. Also, as shown in FIGS. 2 and 4, the extended strip 21 has a transparent top covering 23, opaque sides 25,26 and opaque bottom surface 27. The strip 21 is a plastic such as polyvinylchloride (PVC) or some other suitable plastic material which has a transparent top covering and opaque bottom and sides which block transmittal of light to the outside thus limiting or transmitting light only through the transparent top covering 23.

As shown in FIG. 2 a series of light emitting diodes 29 (LED's) are installed on the top surface of the extended strip 21 in a row in predetermined spaced apart manner. The LED's are in contact with the electric wires 17,19 along the length of the extended strip 21 and electric current flows through these wires when the electric plug 13 is connected to a source of electric power.

Figure 3:
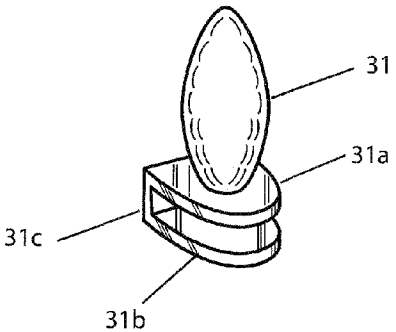
FIG. 3 is a perspective view of a light bulb integral with the light bulb clip for fixedly clipping to the opaque sides of the elongated strip.

Superimposed on each LED, and in electrical contact therewith is a bulb 31 formed from a transparent plastic attached to a generally U-shape base having an upper arm 31*a* and spaced apart lower arm 31*b*, with each arm having a central opening (not shown) aligned with each other and with opening 31*c* at the bottom of the bulb 31 to permit light transmittal from each LED to pass through said opening 31*c* into said bulb for transmittal from each bulb 31 to the surroundings in one pre-selected direction. As seen from FIGS. 1, 3 and 5, each bulb 31 is clipped on top of each LED on the strip 21 by tightly clipping the arms 31*a*,31*b* onto the opaque side of the plastic strip. The bulb 31 is shown here as an electric bulb of the type generally used in illuminating Christmas trees, however, other types of bulbs can also be used which may be different in shape, such as cylindrical shaped bulbs having an open bottom through which light can be transmitted from the LED to the bulb and to the predetermined outer structure.

In the lighting system hereinbefore described the extended strip 21 is a strip of flexible PVC although it may be made of other flexible materials so long as it has one transparent covering side and opaque sides as well as opaque under covering, i.e., the opposite side of the transparent covering sides. This will insure that the light transmitted by the LED's will be transmitted in one direction only with higher intensity than would otherwise be possible if all sides of the extended strip 21 were transparent to passage of light.

The length of the extended strip 21 may be several feet, depending upon the structure being illuminated and the number of LED's may be varied as desired for providing the desired degree of illumination. Also, while the bulbs used for transmitting the light from the LED's 31 on electrical strip 21 have been described with certain degree of particularity and shape, other light transmitting bulbs may be used so long as each bulb is in contact with an LED and is capable of transmitting the light emitted by each LED to its associated bulb and through the bulb directed toward the desired structure.

While the system of the present invention has been described with a certain degree of particularity other obvious modifications may be made which are suggested from the detailed description herein.

The invention claimed is:

1. A generally rectangular tubular electric lighting system capable of transmitting electric light in only one predetermined direction, said tubular electric lighting system defined by a strip of elongated flexible plastic formed with a top light transmitting surface and opaque bottom and side surfaces, wherein light is transmitted through said light transmitting surface in only one direction, said open top having a transparent cover, a pair of generally parallel electric wires extending through said top surface electrically connected to a source of electrical power, several spaced apart light emitting diodes each placed on said top surface and connected to said pair of electric wires, a light emitting bulb positioned in contact with each of said light emitting diodes and adapted to transmit light from each of said light emitting diodes to the outside of said bulb in one predetermined direction through the light transmitting side surface.

2. An electric lighting system as in claim 1 wherein each of said bulbs is preformed with an open bottom having a generally U-shaped base having a central opening aligned with said open bottom of said bulb thereby allowing transmittal of light through said base to said bulb and out through said predetermined direction.

3. An electric system as in claim 1 wherein said light emitting diodes are spaced equidistantly.

4. An electric system as in claim 2 wherein said light emitting diodes are spaced equidistantly.

5. An electric system as in claim 1 wherein said plastic strip is made of polyvinylchloride.

6. An electric system as in claim 2 wherein said plastic strip is made of polyvinylchloride.

7. An electric system as in claim 3 wherein said plastic strip is made of polyvinylchloride.

8. An electric system as in claim 4 wherein said plastic strip is made of polyvinylchloride.

* * * * *